US010293233B2

(12) United States Patent
Creguer

(10) Patent No.: US 10,293,233 B2
(45) **Date of Patent: *May 21, 2019**

(54) SPORTS TRAINING SYSTEM

(71) Applicant: Thomas Creguer, Mount Pleasant, MI (US)

(72) Inventor: Thomas Creguer, Mount Pleasant, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/194,018

(22) Filed: Jun. 27, 2016

(65) Prior Publication Data

US 2016/0303449 A1 Oct. 20, 2016

Related U.S. Application Data

(60) Continuation of application No. 14/277,318, filed on May 14, 2014, now Pat. No. 9,375,620, which is a (Continued)

(51) Int. Cl.
*A63B 69/00* (2006.01)
*A63B 41/00* (2006.01)
(Continued)

(52) U.S. Cl.
CPC ..... *A63B 69/00* (2013.01); *A63B 41/00* (2013.01); *A63B 43/00* (2013.01); *A63B 43/002* (2013.01);
(Continued)

(58) Field of Classification Search
CPC ..... G01N 3/42; G01L 17/00; A63B 69/00; A63B 41/00; A63B 43/00; A63B 43/002; A63B 43/004; A63B 45/00; A63B 69/002; A63B 71/0622; A63B 47/008; A63B 2071/0625; A63B 2071/0627; A63B 2071/063; A63B 2071/0658; A63B 2220/51; A63B 2220/56; A63B 2225/20; A63B 2243/0025; A63B 2243/0037;
(Continued)

(56) References Cited

U.S. PATENT DOCUMENTS 2,053,450 A 9/1936 Twiss et al.
2,194,132 A 3/1940 Voit et al.
(Continued)

OTHER PUBLICATIONS

CMU Students Design Equipment That Senses Football Moves, http://post-gazette.com/pg/08352/935526-115. stm, Dec. 17, 2008.

*Primary Examiner* — Mitra Aryanpour
(74) *Attorney, Agent, or Firm* — Carlson, Gaskey & Olds, P.C.

(57) ABSTRACT

A method of assembling a sports training ball includes locating at least one force sensor in the sports training ball for measuring an elevated force applied to the sports training ball. The sports training ball includes an outer surface that surrounds an inner core. An indicator is located in the sports training ball. The indicator is in electrical communication with at least one force sensor and is configured to receive a change in an electrical signal when the elevated force measured by at least one force sensor decreases below a predetermined elevated threshold. The indicator is configured to indicate to a user when the indicator receives the change in the electrical signal with a change in at least one of an audio signal or a visual signal.

21 Claims, 6 Drawing Sheets

Related U.S. Application Data division of application No. 13/110,039, filed on May 18, 2011, now Pat. No. 8,758,172.

(51) Int. Cl.
*A63B 43/00* (2006.01)
*A63B 45/00* (2006.01)
*A63B 71/06* (2006.01)

(52) U.S. Cl.
CPC ..... *A63B 43/004* (2013.01); *A63B 45/00* (2013.01); *A63B 69/002* (2013.01); *A63B 71/0622* (2013.01); *A63B 2071/063* (2013.01); *A63B 2071/0625* (2013.01); *A63B 2071/0627* (2013.01); *A63B 2071/0658* (2013.01); *A63B 2220/51* (2013.01); *A63B 2220/56* (2013.01); *A63B 2225/20* (2013.01); *A63B 2243/007* (2013.01); *A63B 2243/0025* (2013.01); *A63B 2243/0037* (2013.01); *A63B 2243/0066* (2013.01); *A63B 2243/0095* (2013.01)

(58) Field of Classification Search
CPC ..... A63B 2243/0066; A63B 2243/007; A63B 2243/0095; B29D 22/04
USPC ..... 473/422, 438, 450, 458, 464, 569–571, 473/198, 200, 605; 482/8, 84; 73/818, 73/81, 82; 600/595
See application file for complete search history.

(56) References Cited

U.S. PATENT DOCUMENTS 2,628,496 A 2/1953 Malcolm
3,376,734 A 4/1968 Ether
3,665,757 A 5/1972 Hoag
4,136,554 A 1/1979 Larson
4,534,557 A * 8/1985 Bigelow ..... A63B 43/00 473/438
4,577,865 A 3/1986 Shishido
4,595,200 A * 6/1986 Shishido ..... A63B 43/00 473/570
4,732,038 A * 3/1988 DelGiorno ..... A61B 5/224 600/595
4,883,271 A * 11/1989 French ..... A63B 24/0021 482/84
5,222,391 A 6/1993 Reenstra
5,288,069 A 2/1994 Matsumoto
5,291,774 A 3/1994 Putnam, Jr.
5,316,293 A 5/1994 Hamilton
5,511,410 A 4/1996 Sherts
5,526,326 A 6/1996 Fekete et al.
5,567,870 A 10/1996 Harris
5,639,969 A 6/1997 D'Adamo
5,700,204 A 12/1997 Teder
5,760,312 A 6/1998 MacKay et al.
5,761,096 A 6/1998 Zakutin
5,779,576 A 7/1998 Smith et al.
5,837,889 A 11/1998 Slenker
6,033,370 A 3/2000 Reinbold et al.
6,188,742 B1 * 2/2001 Schousek ..... G01D 21/00 377/19
6,196,073 B1 3/2001 Harding
6,357,282 B1 3/2002 Benjamin
6,360,613 B1 3/2002 Iggulden
6,582,330 B1 6/2003 Rehkemper et al.
6,612,182 B1 9/2003 Iggulden et al.
6,755,085 B1 6/2004 Kazanjian et al.
7,014,526 B1 * 3/2006 Chamberlin ..... A63H 5/00 248/694
7,054,784 B2 5/2006 Flentov et al.
7,175,553 B2 2/2007 Laliberty et al.
7,273,431 B2 9/2007 DeVall
7,811,163 B2 * 10/2010 Ratcliffe ..... A63B 24/0021 473/131
7,815,516 B1 * 10/2010 Mortimer ..... A63B 24/0021 473/257
8,512,177 B2 8/2013 Krysiak et al.
8,540,560 B2 9/2013 Crowley et al.
8,597,095 B2 12/2013 Crowley et al.
8,827,847 B2 * 9/2014 Johnson ..... A63B 69/3632 473/422
9,227,128 B1 * 1/2016 Carfagna, Jr. ..... A63B 69/32 482/84
2003/0216228 A1 * 11/2003 Rast ..... A63B 21/0087 482/84
2003/0217582 A1 * 11/2003 Reinbold ..... A63B 69/32 73/12.09
2005/0266967 A1 * 12/2005 Considine ..... A63B 69/20 482/84
2008/0185785 A1 8/2008 Sullivan
2008/0284650 A1 11/2008 Macintosh et al.
2009/0048070 A1 2/2009 Vincent et al.
2010/0326201 A1 12/2010 Brandt
2011/0118062 A1 5/2011 Krysiak et al.
2012/0139727 A1 6/2012 Houvener et al.
2012/0198593 A1 * 8/2012 Beck ..... F41H 1/02 2/2.5
2012/0220430 A1 8/2012 Bucar et al.
2014/0248979 A1 9/2014 Creguer

* cited by examiner

SPORTS TRAINING SYSTEM

REFERENCE TO RELATED APPLICATIONS

This application is a continuation of U.S. patent application Ser. No. 14/277,318 filed May 14, 2014 which is a divisional of U.S. patent application Ser. No. 13/110,039 filed on May 18, 2011, which is now issued U.S. Pat. No. 8,758,172 granted Jun. 24, 2014.

BACKGROUND

This disclosure generally relates to a sports training device. More particularly, this disclosure relates to a training device which measure forces applied to a ball.

Many athletes want to gain a competitive edge over their competition. Many various devices are available to measure an athlete's performance.

SUMMARY

In one exemplary embodiment, a method of assembling a sports training ball includes locating at least one force sensor in the sports training ball for measuring an elevated force applied to the sports training ball. The sports training ball includes an outer surface that surrounds an inner core. An indicator is located in the sports training ball. The indicator is in electrical communication with at least one force sensor and is configured to receive a change in an electrical signal when the elevated force measured by at least one force sensor decreases below a predetermined elevated threshold. The indicator is configured to indicate to a user when the indicator receives the change in the electrical signal with a change in feedback.

In another exemplary embodiment, a sports training device includes a training ball that includes an outer layer that surrounds an inner core. At least one force sensor is located in the sports training ball and is in contact with at least one of the outer layer or the inner core. At least one force sensor is configured to measure an elevated force applied to the sports training ball. An indicator is in contact with at least one of the outer layer and the inner core. The indicator is in electrical communication with the at least one force sensor and is configured to receive a change in an electrical signal when the elevated force measured by at least one force sensor decreases below a predetermined elevated threshold. The indicator is configured to indicate to a user when the indicator receives the change in the electrical signal with a change in feedback.

In another exemplary embodiment, a sports training device includes a training ball that has an outer surface that surrounds an inner core. At least one force sensor is configured to measure an elevated force applied to the training ball. At least one force sensor is in contact with at least one of the outer surface or the inner core. A controller is configured to determine when the elevated force measured by at least one force sensor decreases below a predetermined threshold. At least one indicator is in communication with the controller and is configured to indicate when the elevated force measured by at least one force sensor decreases below the predetermined threshold.

BRIEF DESCRIPTION OF THE DRAWINGS

These and other features of the present invention can be best understood from the following specification and drawings, the following of which is a brief description.

DETAILED DESCRIPTION OF THE PREFERRED EMBODIMENT

Figure 1:
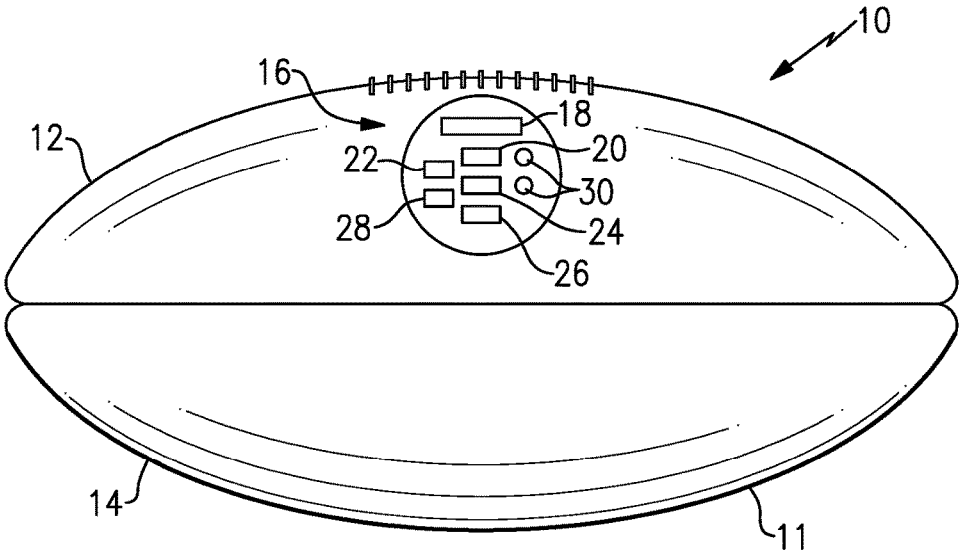
FIG. 1 illustrates a first side of view of one non-limiting embodiment training device.

FIG. 1 illustrates one non-limiting embodiment of a training device 10. The training device 10 generally includes a ball 11, such as a football, a soccer ball, a volleyball, a rugby ball, a basketball, or other device which may not necessarily be a ball. The ball 11 may also be made of a solid foam or rubber. The ball 11 may have a first panel 12, a second panel 14, a third panel 32 (FIG. 2), a fourth panel 34 (FIG. 2), and a control module 16 integrally attached with the first panel 12. The panels 12, 14, 32, and 34 allow for the ball 11 to be more easily manufactured. The control module 16 includes a display 18, a controller 20, such as a microprocessor, a power supply 22, memory 24, an I/O port 26, a power control 28, and adjustment controls 30. The training device 10 provides a user with feedback regarding an amount of force being applied to the training device 10.

Figure 2:
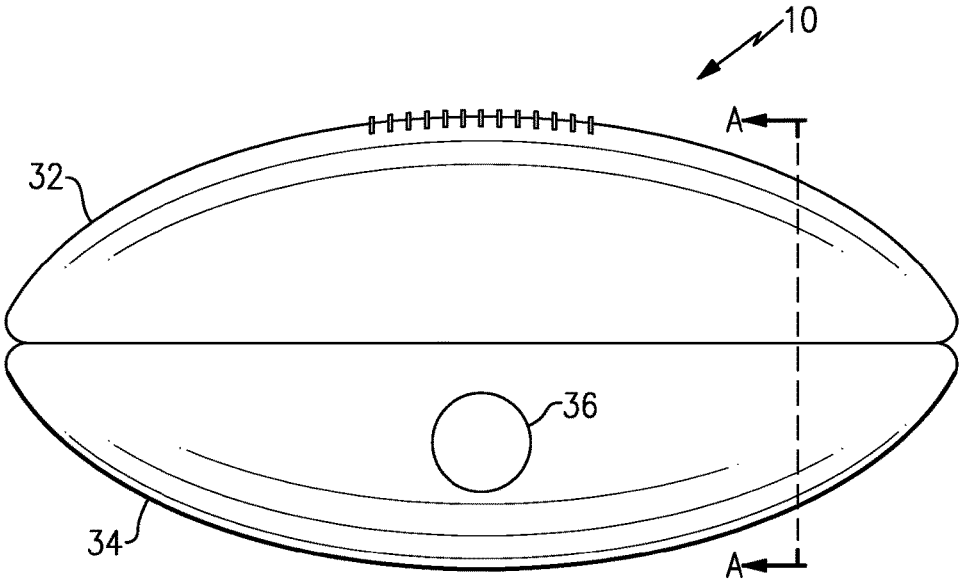
FIG. 2 illustrates a second side view of the training device of FIG. 1.

FIG. 2 illustrates a second side view of the training device 10 with the third panel 32 and the fourth panel 34. An indicator 36, such as a speaker, a light, or another device capable of communicating with a user, is located in the fourth panel 34 opposite the control module 16 to balance the weight of the ball 11. The controller 20 sends a control signal to the indicator 36 when a force applied to the training device 10 falls below a predetermined threshold. The control signal may correspond to a light, a beep, or an audible voice. The adjustment controls 30 vary the predetermined threshold force level. The power control 28 activates or deactivates the training device 10 and may select different modes of operation, such as delaying the controller 20 from sending the control signal to the indicator 36.

Figure 3:
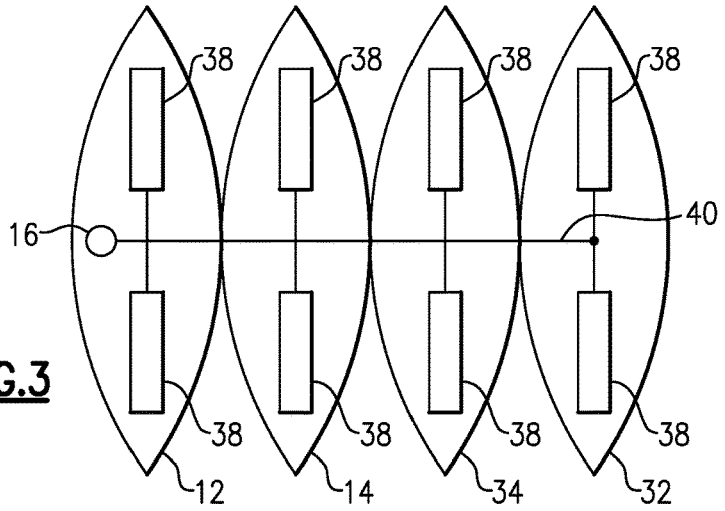
FIG. 3 illustrates an interior view of panels of the training device of FIG. 1.

FIG. 3 illustrates an interior view of the first panel 12, the second panel 14, the third panel 32, and the fourth panel 34. Sensors 38, such as stress-strain gauges, restrictive flex sensors, or another similar type of sensor, are located on an interior surface of the panels 12, 14, 32, and 34 and are connected by an electrical connection 40 to the control module 16 for measuring deflection and/or forces applied to the panels 12, 14, 32, or 34. The controller 20 receives signals from the sensors 38, which can be displayed on the display 18 and/or stored in the memory 24. The controller 20 may also store the maximum and minimum forces applied to the training device.

The training device 10 may be activated by applying a force, which is received by the sensors 38, to the training device 10. The power supply 22, such as a battery, powers the control panel 16, the indicator 36, and the sensors 38. Although the power supply 22 is shown within the control panel 16, the power supply can be located remote from the control panel 16. The I/O port 26 is in electrical communication with the DC bus 39 for transferring the data stored on the memory 24 to another memory device, such as a USB drive.

Figure 4:
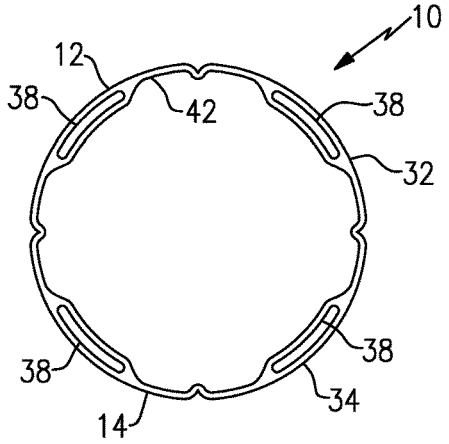
FIG. 4 illustrates a cross-section view of the training device of FIG. 1 taken along line A-A of FIG. 2.

FIG. 4 illustrates a cross-section view of the training device 10 taken along line A-A of FIG. 2. The sensors 38 are located between the panels 12, 14, 32, and 34 and an inner bladder 42.

Figure 5:
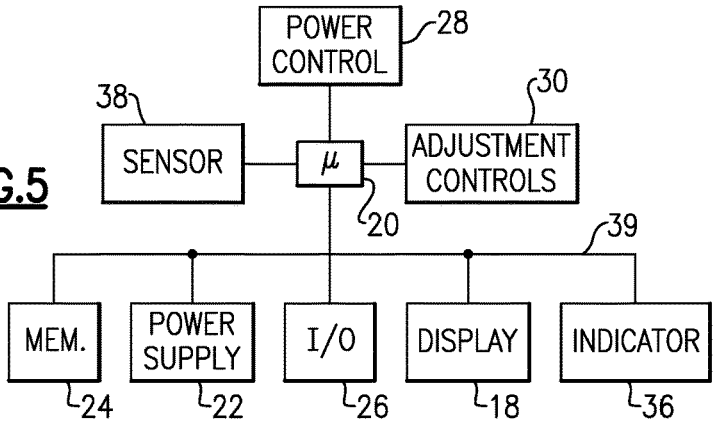
FIG. 5 illustrates a schematic view of the training device of FIG. 1.

FIG. 5 illustrates a schematic view of the training device 10 having a DC bus 39. The memory 24, the power supply 22, the I/O port 26, the display 18, and the indicator 36 are in communication with the controller 20 over the DC bus 39. The sensors 38, the power control 28, and the adjustment controls 30 are in direct electrical communication with the controller 20.

Figure 6:
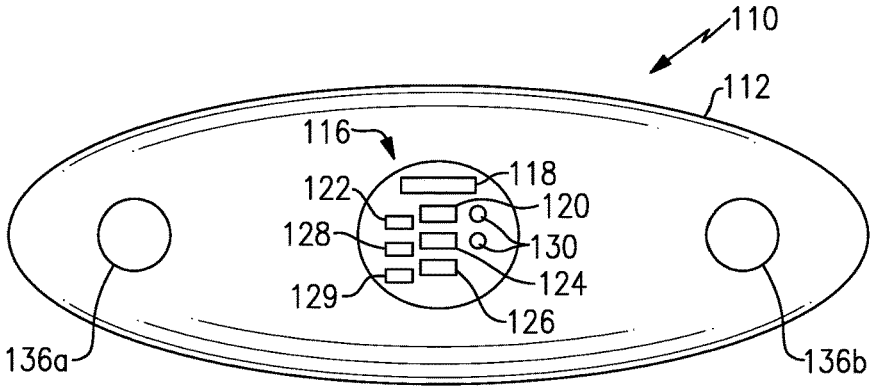
FIG. 6 illustrates another non-limiting embodiment of an external training device.
Figure 8:
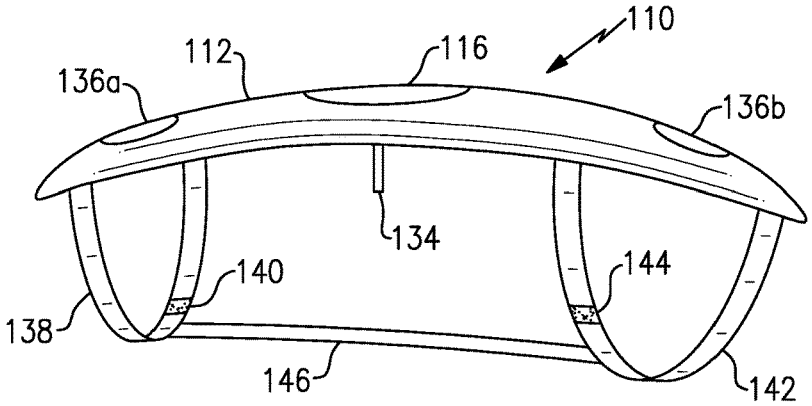
FIG. 8 illustrates a side view of the external training device of FIG. 6 having a connecting member.

FIG. 6 illustrates another non-limiting embodiment of an external training device 110 having a body portion 112 including a control module 116, a first indicator 136*a* and a second indicator 136*b*. The body portion 112 is made of rubber, foam, or another similar soft and resilient material that matches the texture and feel of a ball 100 (FIG. 8). The first indicator 136*a* and the second indicator 136*b* may include a speaker, a light, or another device capable of communicating to a user. The control module 116 includes a display 118, a controller 120, such as a microprocessor, a power supply 122, memory 124, an I/O port 126, a power control 128, a pressure sensor 129, and adjustment controls 130.

Figure 7:
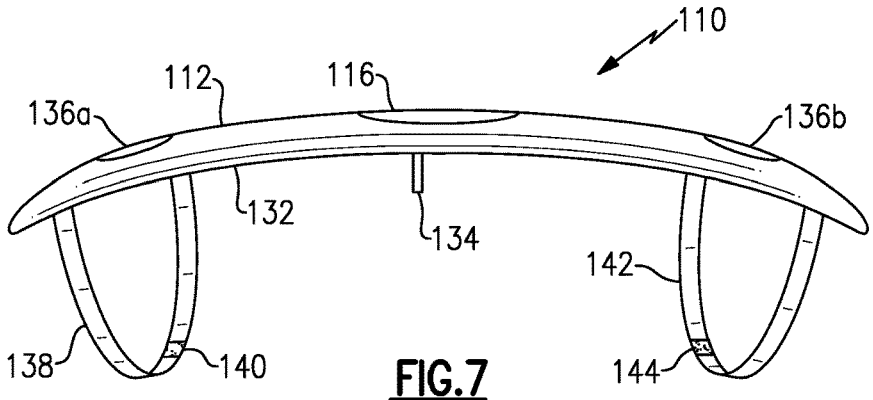
FIG. 7 illustrates a side view of the external training device of FIG. 6.

FIG. 7 illustrates a side view of the external training device 110 including a first attachment member 138 having a first engagement portion 140 and a second attachment member 142 having a second engagement portion 144. The first and second engagement portions 142 and 144 may include a button, snap, hook and loop closure, or another similar type of engagement. A pressure engagement member 134, such a pressure needle, extends from a lower contoured surface 132 of the body portion 112 and is in fluid communication with the pressure sensor 129. FIG. 7 illustrates a side view of the external training device 110 with a connecting attachment member 146 extending between the first and second attachment members 138 and 142.

Figure 9:
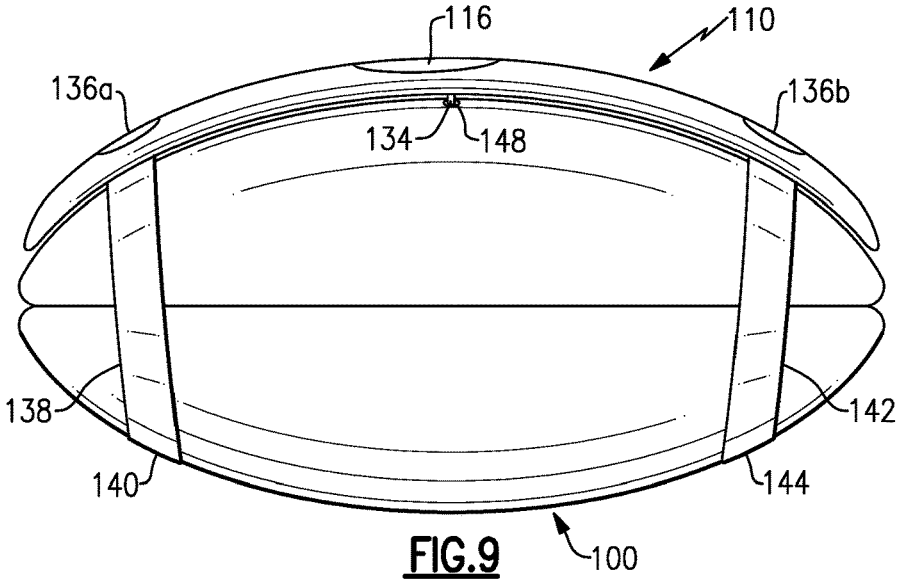
FIG. 9 illustrates a side view of the external training device of FIG. 6 attached to a ball.

FIG. 9 illustrates a side view of the external training device 110 located on the ball 100, such as a football, a soccer ball, a volley ball, or another similar type of ball, having the contoured surface 132 located adjacent the ball 100. The pressure engagement member 134 extends into a pressure receptacle 148 located on the ball 100 to place the pressure sensor 129 in fluid communication with an internal cavity of the ball 100. The controller 120 receives pressure signals from the pressure sensor 129. The pressure signals can be displayed on the display 118 and/or stored in the memory 124. Additionally, the training device 110 can be activated by applying a force, which is received by the pressure sensor 129, to the training device 110. The power supply 122, such as a battery, powers the control panel 116, the indicators 136*a* and 136*b*, and the pressure sensor 129. Although the power supply 122 is shown within the control module 116, the power supply 122 can be located remotely from the control module 116. The I/O port 126 is in electrical communication with the DC bus 139 for transferring data stored on the memory 124 to another memory device, such as a USB drive.

The controller 120 sends a control signal to the indicators 136*a* and 136*b* when a force applied to the training device 110 falls below a predetermined threshold as determined by a change in pressure in the ball 100 measured by the pressure sensor 129. The control signal corresponds to a light, a beep, or an audible voice. The adjustment controls 130 vary the predetermined threshold level. The power control 128 can activate or deactivate the training device 110 and may select different modes of operation, such as delaying the controller 120 sending the control signal to the indicators 136*a* and 136*b*.

Figure 10:
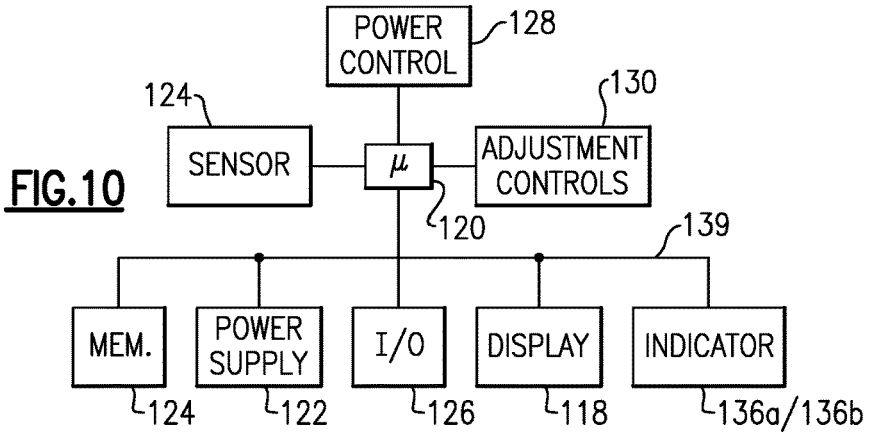
FIG. 10 illustrates a schematic view of the external training device of FIG. 6.

FIG. 10 illustrates a schematic view of the training device 110 having a DC bus 139. The memory 124, the power supply 122, the I/O port 126, the display 118, and the indicators 136*a* and 136*b* are in communication with the controller 120 over the DC bus 139. The pressure sensor 129, the power control 128, and the adjustment controls 130 are in direct electrical communication with the controller 120.

Figure 11:
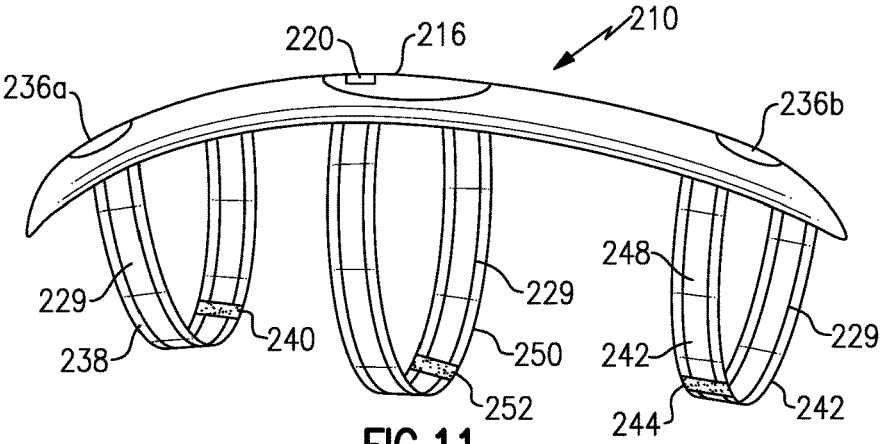
FIG. 11 illustrates another non-limiting embodiment of an external training device.

FIG. 11 illustrates another non-limiting embodiment of an external training device 210. The external training device 210 is similar to the external training device 110 except where shown in the drawings or described below. The external training device 210 includes a first attachment member 238 having a first engagement portion 240 and sensors 229, a second attachment member 242 having a second engagement portion 244 and sensors 229, and a third attachment member 250 having a third engagement portion 252 and sensors 229. The sensors 229 may include stress-strain gauges, restrictive flex sensors, or another similar type of sensor.

Figure 12:
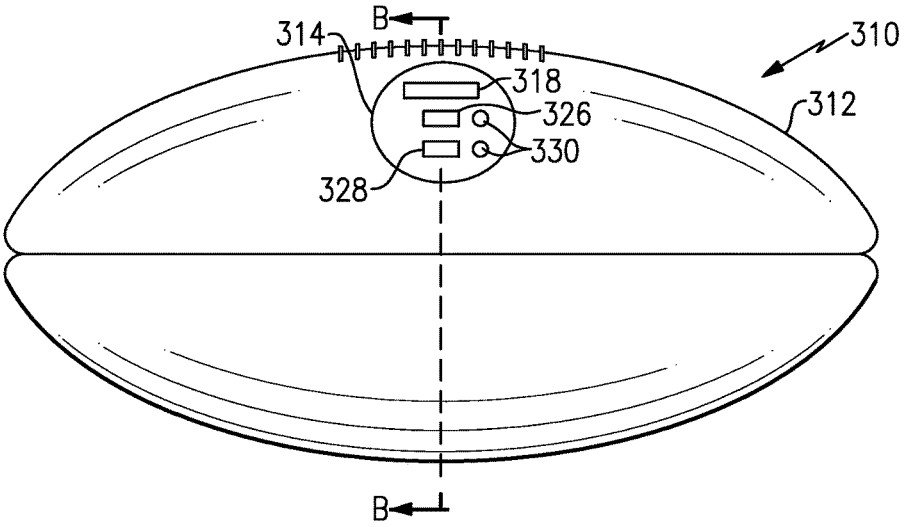
FIG. 12 illustrates another non-limiting embodiment of a training device.

FIG. 12 illustrates another non-limiting embodiment of a training device 310. A user module 314 is integrally attached to an exterior portion 312 and includes a display 318, an I/O port 326, a power control 328, and adjustment controls 330. The exterior portion 312 is made of a foam or rubber material.

Figure 13:
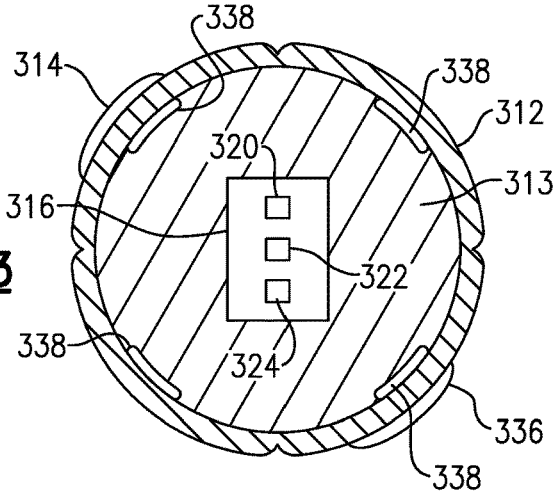
FIG. 13 illustrates a cross-section view of the training device of FIG. 12 taken along line B-B of FIG. 12.

FIG. 13 illustrates a cross-section view of the training device 310 taken along line B-B of FIG. 12 showing the exterior portion 312 and an interior portion 313 made of foam or rubber. An indicator 336 is located on an opposite side of the training device 310 as the user module 314 to balance the weight of the training device 310. A control module 316 including a controller 320, a power supply 322, and a memory 324 is located in the center of the interior portion 313 for balancing the weight of the training device 310. Sensors 338 are located between the interior portion 313 and exterior portion 312 for measuring deflection and/or forces applied to the training device 310.

Figure 14:
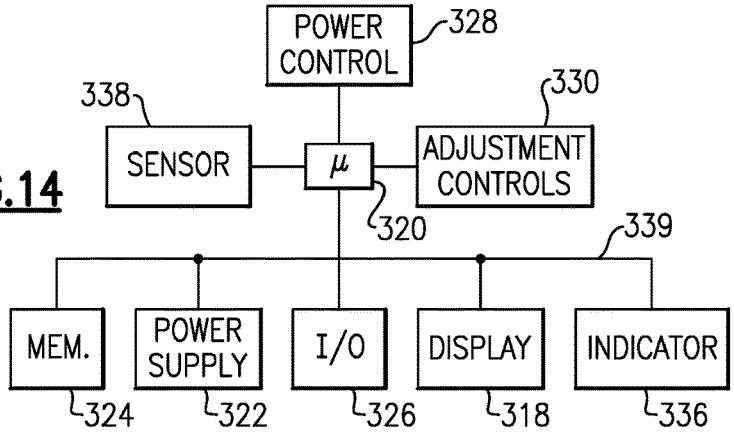
FIG. 14 illustrates a schematic view of the training device of FIG. 12.

FIG. 14 illustrates a schematic view of the training device 310 having a DC bus 339. The memory 324, the power supply 322, the I/O port 326, the display 318, and the indicator 336 are in communication with the controller 320 over the DC bus 339. The sensors 338, the power control 328, and the adjustment controls 330 are in direct electrical communication with the controller 320.

Figure 15:
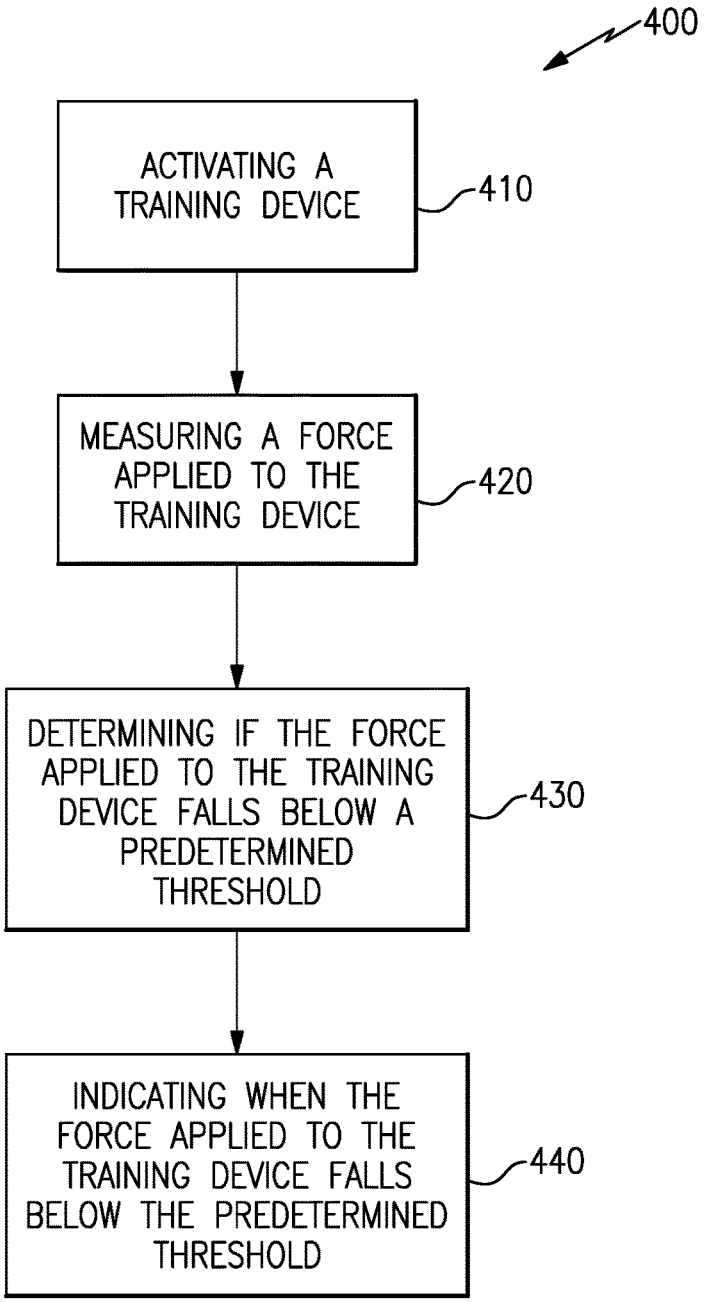
FIG. 15 illustrates an example method of operating a training device.

FIG. 15 illustrates an example method 400 of operating the training device 10, 110, 210, or 310. The method 300 includes activating the training device 10, 110, 210, or 310. (Step 410). The training device 10, 110, 210, or 310 may be activated by engaging the power control 28, 128, 228, or 328. Alternatively, the training device 10, 110, 210, or 310 could be activated by applying a force to the training device 10, 110, 210, or 310.

The method further includes the step of measuring a force, such as a compressive force, applied to the training device 10, 110, 210, or 310. (Step 420). The training devices 10, 210, and 310 utilize sensors 38, 238, and 338 to measure an applied force. The training device 110 utilizes the pressure sensor 129 to measure an applied force.

The method further includes the step of determining if the force applied to the training device 10, 110, 210, or 310 falls below a predetermined threshold based on changes from a steady state pressure of training device 10, 110, 210, and 310. (Step 430). The training device 10, 110, 210, or 310 includes adjustment controls 30, 130, 230 or 330, respectively, for adjusting the predetermined threshold. The training device 10, 110, 210, or 310 measures the force applied with sensors 38, 129, 248, or 338, respectively.

The method further includes the step of indicating when the force applied to the training device 10, 110, 210, or 310 falls below the predetermined threshold. (Step 440). The controller 20, 120, 220, or 320 sends control signals to the indicators 36, 136*a* and 136*b*, 236*a* and 236*b*, or 336, respectively to indicate when the force applied to the training device 10, 110, 210, or 310 falls below the predetermined threshold.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A sports training device comprising:

a training ball including an outer layer surrounding an inner core, wherein the training ball is a football;

at least one force sensor located in the training ball in contact with at least one of the outer layer or the inner core, the at least one force sensor configured to measure an elevated force applied to the training ball at a predetermined elevated threshold level; and an indicator in contact with at least one of the outer layer and the inner core, the indicator in electrical communication with the at least one force sensor and configured to receive a change in an electrical signal when the elevated force measured by the at least one force sensor decreases below the predetermined elevated threshold level, wherein the indicator is configured to indicate to a user when the indicator receives the change in the electrical signal with a change in feedback.

2. The device as recited in claim 1, wherein the at least one force sensor is a pressure sensor.

3. The device as recited in claim 1, wherein the change in feedback is at least one of an audio signal or a visual signal.

4. The device as recited in claim 1, wherein a first side of the at least one force sensor contacts the inner core and a second opposite side of the at least one force sensor contacts the outer layer.

5. The device as recited in claim 1, wherein the inner core includes a bladder.

6. The device as recited in claim 5, wherein the at least one force sensor is in contact with at least one of the outer layer or the inner core.

7. The device as recited in claim 1, wherein the at least one force sensor includes a first sensor located on a first side of the training ball, a second sensor located on a second side of the training ball opposite the first side, a third sensor located on a third side of the training ball, and a fourth sensor located on a fourth side of the training ball opposite the third side.

8. The device as recited in claim 1, including a controller located in the training ball in electrical communication with the at least one force sensor.

9. A sports training device comprising:

a training ball having an outer surface surrounding an inner core;

at least one force sensor configured to measure an elevated force applied to the training ball at a predetermined elevated threshold level, wherein the at least one force sensor is in contact with at least one of the outer surface or the inner core;

a controller configured to determine when the elevated force measured by the at least one force sensor decreases below the predetermined elevated threshold level; and at least one indicator in communication with the controller, the at least one indicator configured to indicate when the elevated force measured by the at least one force sensor decreases below the predetermined elevated threshold level as determined by the controller.

10. The device of claim 9, wherein the inner core includes a bladder and the at least one force sensor includes a plurality of force sensors and the plurality of force sensors each directly contact the bladder.

11. The device of claim 9, wherein the training ball is a football.

12. The device of claim 11, wherein the indicator is in contact with at least one of the outer surface and the inner core.

13. The device as recited in claim 12, wherein the at least one force sensor includes a first sensor located on a first side of the training ball, a second sensor located on a second side of the training ball opposite the first side, a third sensor located on a third side of the training ball, and a fourth sensor located on a fourth side of the training ball opposite the third side.

14. The device as recited in claim 12, wherein the at least one force sensor includes a first sensor located on a first side of the training ball, a second sensor located on a second side of the training ball opposite the first side.

15. The device as recited in claim 14, wherein the controller is configured to send a signal to the at least one indicator to indicate to a user when the elevated force measured by the at least one force sensor decreases below the predetermined elevated threshold level.

16. The device as recited in claim 15, wherein the at least one indicator is configured to provide an audible alert.

17. The device as recited in claim 15, wherein the at least one indicator is configured to provide visual alert.

18. The device as recited in claim 1, wherein the at least one force sensor includes a first sensor located on a first side of the training ball, a second sensor located on a second side of the training ball opposite the first side.

19. The device as recited in claim 18, wherein the indicator is in contact with the outer layer and the inner core.

20. The device as recited in claim 19, wherein a first side of the at least one force sensor contacts the inner core and a second opposite side of the at least one force sensor contacts the outer layer.

21. The device as recited in claim 8, wherein the controller is configured to determine when the elevated force measured by the at least one force sensor decreases below the predetermined elevated threshold level.

* * * * *